US005475961A

United States Patent [19]

Menchetti

[11] Patent Number: 5,475,961

[45] Date of Patent: Dec. 19, 1995

[54] VERTICAL POST ASSEMBLY

[75] Inventor: Robert J. Menchetti, Buffalo, N.Y.

[73] Assignee: National Gypsum Company, Charlotte, N.C.

[21] Appl. No.: 80,160

[22] Filed: Jun. 21, 1993

Related U.S. Application Data

[63] Continuation-in-part of Ser. No. 858,797, Mar. 27, 1992, abandoned.

[51] Int. Cl.[6] ..... E04B 2/28; E04C 3/07

[52] U.S. Cl. ..... 52/481.1; 52/30; 52/236.3; 52/266; 52/275; 52/282.1; 52/764; 52/780; 52/781; 52/731.9; 52/731.7

[58] Field of Search ..... 52/30, 275, 481.1, 52/481.2, 731.7, 731.8, 731.9, 234, 236 B, 266, 282.1, 506.06, 762, 764, 780, 781, 731.5, 236.3

[56] References Cited

U.S. PATENT DOCUMENTS

| | | | |
|---|---|---|---|
| 2,316,668 | 4/1943 | Bronner | 52/764 |
| 2,976,971 | 3/1961 | Lundberg | 52/731.7 |
| 3,495,417 | 2/1970 | Ratliff, Jr. | 52/481.1 |
| 3,702,044 | 11/1972 | Balinski | 52/781 |
| 3,866,376 | 2/1975 | Nelsson . | |
| 3,921,346 | 11/1975 | Sauer et al. . | |
| 4,074,486 | 2/1978 | Grearson | 52/781 |
| 4,129,970 | 12/1978 | Whitney . | |
| 4,918,879 | 4/1990 | Bodurow et al. . | |
| 5,092,100 | 3/1992 | Lambert et al. . | |

FOREIGN PATENT DOCUMENTS

| | | | |
|---|---|---|---|
| 493129 | 12/1936 | United Kingdom | 52/781 |

*Primary Examiner*—Carl D. Friedman
*Assistant Examiner*—Christopher Todd Kent
*Attorney, Agent, or Firm*—Marshall, O'Toole, Gerstein, Murray & Borun

[57] ABSTRACT

A hollow shaft wall with horizontal studs held between corner posts and an intermediate vertical wall support post, which intermediate post has a central reinforcement channel, the reinforcement channel has a bottom and two side walls, the channel is filled with strips of gypsum board, and the two side walls have metal channels affixed thereto providing oppositely opening grooves for receiving and supporting the ends of said horizontal studs.

21 Claims, 2 Drawing Sheets

VERTICAL POST ASSEMBLY

RELATED PATENT APPLICATION

This application is a continuation-in-part of my application Ser. No. 07/858,797, filed Mar. 27, 1992 now abandoned.

This invention relates to a vertical post assembly for supporting and adjoining a pair of coplanar horizontal stud walls.

BACKGROUND OF THE INVENTION

A novel wall construction, particularly advantageous for surrounding elevator shafts and the like, is disclosed in copending U.S. patent application Ser. No. 07/858,797, filed Mar. 27, 1992, and involves a wall constructed of alternating horizontal metal studs and horizontally extending gypsum core boards. These walls are preferably limited to ten-foot-long sections, however, in FIG. 6 of this copending application an extra-long wall is shown. This extra-long wall includes an intermediate vertical post which divides the wall into lengths of 10 feet or less.

This prior vertical post was formed of two oppositely opening channels, affixed together, back-to-back. Core boards and horizontal studs extend from within corner posts to within a vertical post. Wide wallboards are affixed to the outer flanges of the horizontal studs.

SUMMARY OF THE INVENTION

In the present invention, an improved vertical post is employed. The improved vertical post includes two J-runners and a reinforcement channel. The reinforcement channel has a hat-shaped cross-section. The J-runners are screw attached to the two sides of the reinforcement channel, providing oppositely directed channels for receiving the ends of horizontal studs and horizontally extending core boards.

Preferably the reinforcement channel has narrow, elongate pieces of core board affixed between the two sides of the reinforcement channel, completely filling the space therebetween with relatively fire-resistant stiffening material.

It is an object of the present invention to provide an improved vertical post for receiving and holding the ends of horizontal studs and elongated horizontal core boards at intermediate locations in walls of greater than ten feet in length.

It is a further object to provide an improved horizontal stud wall consisting of the improved vertical post and the horizontal studs and horizontal core boards.

BRIEF DESCRIPTION OF THE DRAWINGS

These and other objects and advantages of the invention will be more readily apparent when considered in relation to the preferred embodiments as set forth in the specification and shown in the drawings in which.

DESCRIPTION OF THE PREFERRED EMBODIMENTS

The present invention relates to an improvement in the construction of walls of over ten-foot length, constructed basically as fully disclosed in my copending application, Ser. No. 07/858,797, filed Mar. 27, 1992, which application is included herein by reference.

Figure 1:
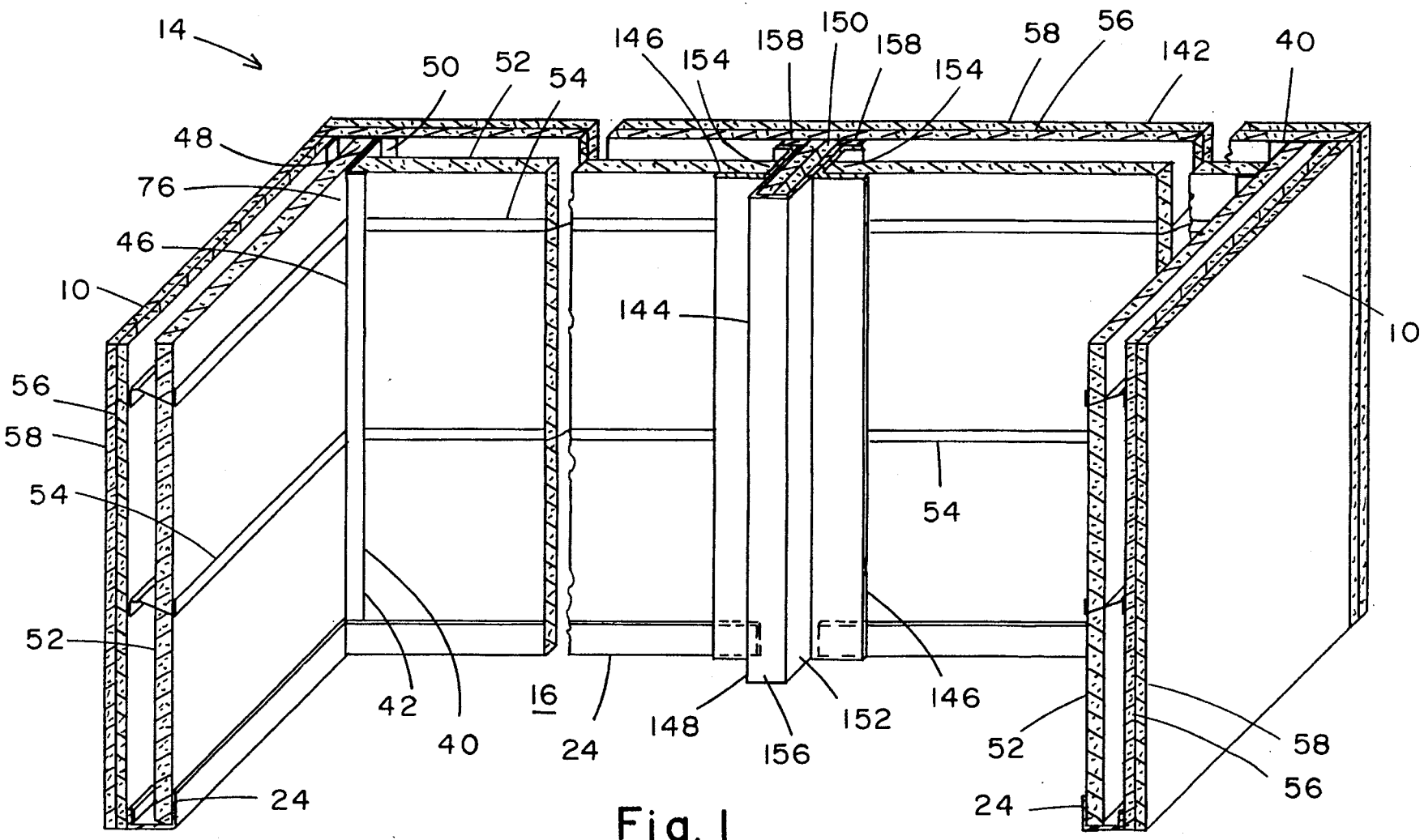
FIG. 1 is an isometric view of a portion of three perpendicular walls of an elevator shaft enclosure, constructed in accordance with the invention.

Referring to FIG. 1, there is shown part of two side walls 10, 10 and an extra-long back wall 142, of a hollow shaft wall structure 14, surrounding an elevator shaft 16. Elevator shaft 16 extends vertically through a plurality of floor-ceiling platforms, including the lower platform 18 and the upper platform 20 of FIG. 2. The shaft wall structure 14 extends vertically from the lower platform 18 to the upper platform 20 along the edges 22 of these floor ceiling platforms which surround and form the elevator shaft 16.

Side wall 10 consists of standard upwardly opening, channel-shaped floor track 24, having a horizontal web 26 and two vertical flanges 28, 30, a downwardly opening, channel shaped, ceiling track 32, having a horizontal web 34 and two vertical flanges 36, 38. Floor track 24 is mechanically affixed to the top of lower platform 18 and ceiling track 32 is mechanically affixed to the bottom of upper platform 20, each adjacent the edges 22 of these floor-ceiling platforms.

At the corner of each side wall 10 and back wall 142, as seen in FIG. 1, a vertical corner post 40 is mounted with a bottom end 42 disposed in a floor track 24 and a top end (not shown) disposed in a ceiling track 32, where the two floor tracks 24 and the two ceiling tracks 32 meet to form a 90° corner 46 between side wall 10 and back wall 142. The corner posts 40, which could be made by affixing two channels together back-to-side, are preferably each a single, elongate, roll-formed sheet of metal having two outwardly opening channels 48, 50 formed of a single piece of 0.020-inch-thick steel, with the two channels 48 and 50 opening outwardly in directions at a 90° angle to one another and being directed toward, respectively, the side walls 10 and the back wall 142.

Figure 2:
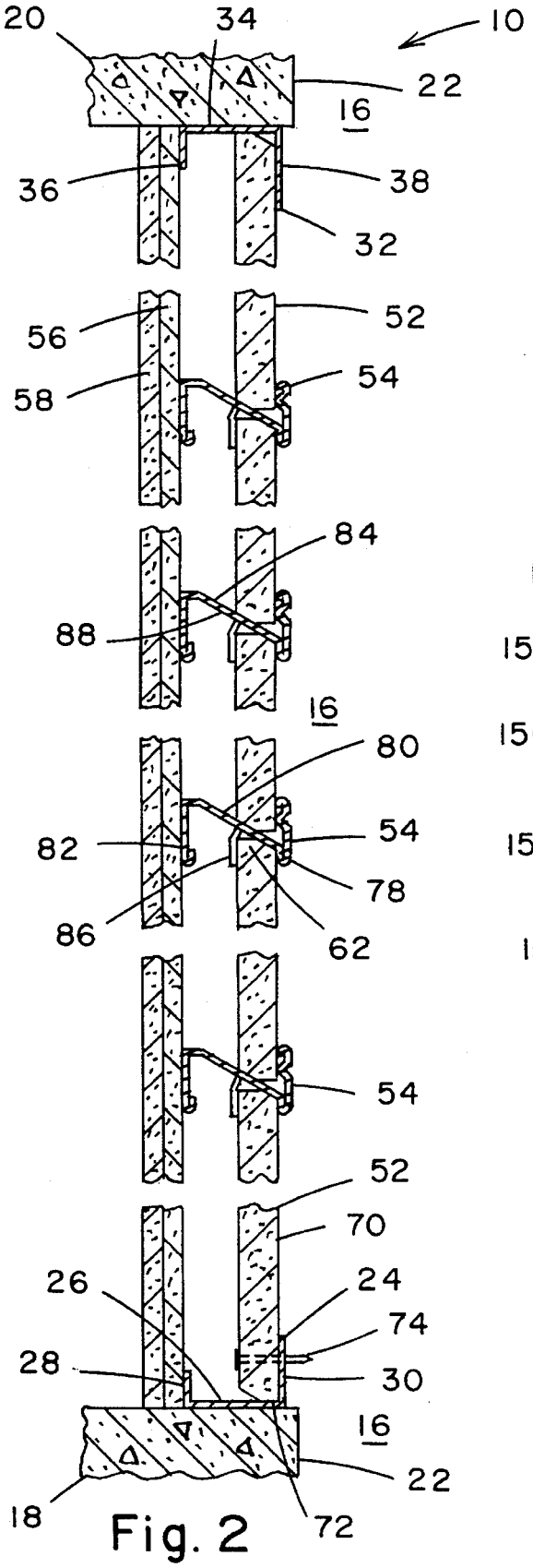
FIG. 2 is a cross-sectional end view of the left side wall of FIG. 1.

Considering the side walls 10, FIG. 2 shows the arrangement of core boards 52, horizontal studs 54, and outwardly disposed gypsum wide wallboards 56, 58, which combine to form the side walls 10.

Typically the core boards 52 are paper-covered gypsum boards which are, in cross section, 2 feet by 1 inch, and will normally have a length equal to the extent of the wall 10.

The first core board 52 to be installed in constructing wall 10 has a flat portion 72 resting on web 26 of floor track 24 and face 70 is held against flange 30 by a plurality of screws 74. The two ends 76 (one shown in FIG. 1) of core board 52 extend into corner posts 40 (one shown) but are not affixed thereto. On top of the first core board 52 to be installed is the first horizontal stud 54 to be installed, and progressively, in constructing wall 10, additional core boards 52 and horizontal studs 54 alternately are put into place, each extending at each end thereof into the channel 48 of corner posts 40 (one shown) but, preferably, neither core boards 52 nor studs 54 are affixed thereto.

The horizontal studs 54, shown in FIGS. 1 and 2, are each a single, elongate, roll-formed sheet of metal, preferably 0.020-inch-thick steel, and include, essentially a Z-shaped cross section which includes an inner flange 78, a web 80 extending outwardly from inner flange 78 with an inwardly facing surface 84 which forms an angle of 60° with inner flange 78, an outer flange 82 which is parallel to and preferably about 2 ½ inches from inner flange 78 and a tab 86 for holding a core board edge 62 against outwardly facing surface 88 of web 80. The stud 54 will be seen to form two opposed pockets for receiving the edges of two adjacent core boards 52.

In the embodiment shown in FIG. 2, all the horizontal studs 54 are disposed with the inner flange 78 extending primarily upwardly from web 80 and the outer flange 82 and tabs 86 extending downwardly from web 80. It will be readily understood how gravity assists in the installation of the upper core board engaged in each stud 54. Two layers of gypsum wide wallboard 56, 58, preferably 4-foot wide and ½-inch or ⅝-inch thick, are screw attached to the outer flange 82 of each horizontal stud 54 and to corner posts 40.

Figure 3:
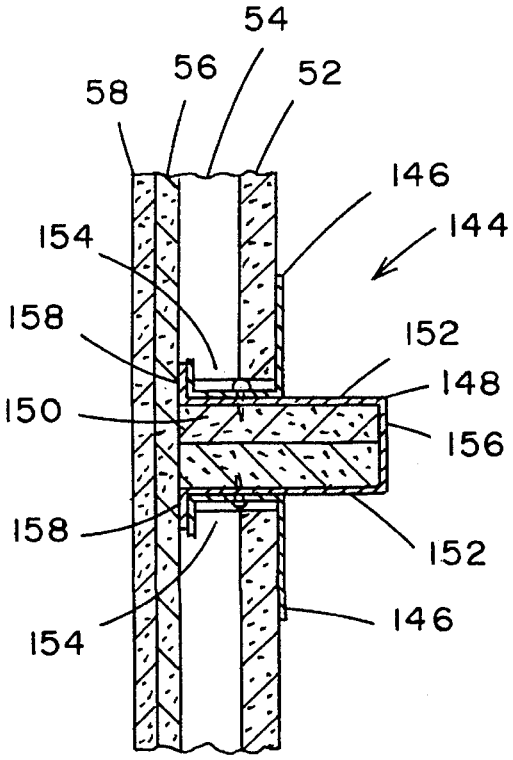
FIG. 3 is a cross-sectional plan view of the back wall at the intermediate vertical post.

Extra-long wall 142, in FIG. 1, is constructed particularly in accordance with the present invention. For walls having an overall length greater than 10 feet, an intermediate vertical post 144 is positioned at spacings of 10 feet or less. A novel intermediate vertical post 144 is shown, in FIG. 3, formed of two channel-shaped J-runners 146, a hat-shaped, elongate, metal reinforcement channel 148 and elongate, narrow strips 150 of core board.

The intermediate post 144 is made by filling the reinforcement channel 148 with nonflammable gypsum core board strips 150 and screwing an elongate, metal channel or runner 146 to each side wall 152 of the reinforcement channel 148. As a result, a highly stiffened post 144 is formed with a pair of grooves 154 opening outwardly from each side.

The hat-shaped reinforcement channel 148 preferably includes, in addition to side walls 152, a bottom 156 and outwardly extending flanges 158, and is about two inches wide and five inches deep. Outwardly extending flanges 158 are each one-inch wide.

Intermediate post 144 extends vertically from a floor track 24 to a ceiling track 32, and is affixed thereto. Horizontally extending core boards 52 and horizontal studs 54 extend into the grooves 154 on each side of the post 144, and are vertically supported thereby.

Generally, intermediate post 144 will be used when a plurality of elevator shafts are located side by side, requiring a plurality of ten-foot sections in the back wall 142 of a shaft wall structure 14. By limiting the length of all horizontal studs 54 in the back wall 142 to no more than ten feet, a single, light gauge, relatively short horizontal stud 54 will be all that is required for all shaft sizes.

The J-runners 146 can be identical to the door-frame posts which are employed at elevator doorways in a shaft wall structure 14, or they can take the form of any suitable metal channel. The core board strips 150 can be made from scraps which result from cutting core boards 52 to smaller sizes for adjusting wall sizes, when necessary.

The use of a reinforcement channel 148 filled with core board strips 150 provides adequate structural strength to permit heights of shaft wall structure walls in excess of thirteen feet without additional support. This back wall 142 with post 144 has been successful in fire endurance tests exceeding two hours.

Having completed a detailed description of the preferred embodiments of my invention so that those skilled in the art may practice the same, I contemplate that variations may be made without departing from the essence of the invention.

I claim:

1. A vertical wall support post comprising an elongate, metal central channel formed by a bottom and two side walls, said bottom and said two side walls forming a central open channel and said central open channel being substantially filled with a nonflammable material, said post further comprising a pair of side channels, opening outwardly in opposite directions away from said side walls, said side channels being secured to said side walls spaced from said bottom and being suitable for the reception and support of vertical wall members.

2. A vertical wall support post as defined in claim 1, wherein said nonflammable material is rigid gypsum.

3. A vertical wall support post as defined in claim 1, wherein said nonflammable material is narrow strips of rigid gypsum core board.

4. A vertical wall support post as defined in claim 1, wherein said side channels are formed by a pair of elongate, metal J-runners affixed to said side walls.

5. A vertical wall support post as defined in claim 4, wherein said nonflammable material is narrow strips of rigid gypsum core board.

6. A vertical wall support post as defined in claim 5, wherein said J-runners are affixed to said side walls by screws which extend into said narrow strips of rigid gypsum core board.

7. A vertical wall support post as defined in claim 1, wherein said elongate, metal central channel has a pair of outwardly extending flanges on said side walls, said flanges being spaced from said bottom.

8. A vertical wall support post as defined in claim 7, wherein said side channels are formed by a pair of metal channel-shaped runners affixed to said side walls and abutting said outwardly extending flanges.

9. A vertical wall support post as defined in claim 1, wherein said central open channel has a depth substantially greater than the width of the pair of side channels extending outwardly from said side walls.

10. A vertical wall support post as defined in claim 9, wherein said depth of said central open channel is about five inches.

11. A hollow wall, extending vertically upwardly from a floor, readily assembleable from a first outer side and suitable for construction where the second inner side is relatively inaccessible, comprising:

(a) two fixed vertical posts each extending upwardly from said floor at each end of said hollow wall and each having a vertically extending channel with a channel opening directed toward the opposite of said vertical posts;

(b) at least one fixed vertical intermediate post located between said ends of said hollow wall having a pair of vertically extending, oppositely directed channels with channel openings directed toward said ends of said hollow wall and a reinforcement channel between said oppositely directed channels, said reinforcement channel having a channel filled with rigid, nonflammable material and a channel opening directed perpendicular to said wall;

(c) at least one horizontally disposed, elongate, formed sheet metal stud, said stud being formed from a single sheet of sheet metal and having an inner flange, a central web and an outer flange;

(d) a plurality of core boards, each said board having an upper edge and a lower edge, each said board having a length substantially equal to the length of said horizontal stud, said lower edge of at least one of said core boards being supported on a central web of said stud immediately therebelow and said upper edge of a second said core board being disposed against and supporting said central web of said stud immediately thereabove, means on said stud holding said core board edges spaced inwardly from said outer flange of said stud;

said horizontal stud and said core boards having opposed ends extending into said channels of said vertical posts; and (e) wallboard affixed to an outer face of said outer flange of said horizontal stud.

12. A hollow wall as defined in claim 11, wherein said hollow wall is greater than 10 feet in length and is divided into a plurality of substantially equal sections by said intermediate posts.

13. A vertical wall having a plurality of coplanar sections, said coplanar sections being reinforced and supported by an intermediate vertical wall support post located between a pair of said wall sections and forming a space between said coplanar sections, said intermediate post having a central reinforcement channel filled with nonflammable, rigid material, said rigid material extending into said space, and a pair of oppositely opening grooves, said wall sections extending into said grooves.

14. A vertical wall as defined in claim 13, wherein said nonflammable, rigid material is gypsum.

15. A vertical wall as defined in claim 14, wherein said gypsum is strips of gypsum board.

16. A vertical wall as defined in claim 13, wherein said oppositely opening grooves are provided by metal channels screwed to side walls of said reinforcement channel.

17. A vertical wall as defined in claim 16, wherein said reinforcement channel has an opening filled with strips of gypsum board and is about two inches wide and five inches deep.

18. A vertical wall as defined in claim 14, wherein said coplanar sections have a wall face on a side thereof and said space appears at said wall face, and said channel and said rigid material protrude through said space and from said wall face.

19. A vertical wall as defined in claim 14, wherein said coplanar sections have a wall face on a side thereof and said space .appears at said wall face, and said channel covers said rigid material across said space at said wall face.

20. A vertical wall comprising first and second wall panels which are parallel and spaced apart to form a hollow wall, said first wall panel comprising at least two coplanar wall sections, said wall sections including an inside surface which faces said second wall panel and an outside surface which faces away from said second wall panel, said wall sections further including vertically extending edges which are adjacent but spaced apart, said vertical wall further comprising a vertical support post which extends between said adjacent edges and is secured to said first and second wall panels, said post comprising first and second channel means, each of said channel means including inside and outside flanges and a web extending between said flanges, said webs of said first and second channel means being secured together and extending between said adjacent edges and perpendicular to said wall panels, said flanges extending parallel to said wall panels, said flanges and said web of each of said channel means forming a channel opening and said channel openings receiving said adjacent edges, said outside flanges overlying and being secured to said outside surfaces of said wall sections, and said inside flanges being secured to said second wall panels.

21. A vertical wall as defined in claim 20, wherein said outside flanges are longer than said inside flanges.

* * * * *